US010358199B1

(12) United States Patent
Kleinigger

(10) Patent No.: US 10,358,199 B1
(45) Date of Patent: Jul. 23, 2019

(54) SCUBA TANK AIR PRESSURE MONITOR SYSTEM

(71) Applicant: Garmin Switzerland GmbH, Schaffhausen (CH)

(72) Inventor: Michael R. Kleinigger, Fuquay Varina, NC (US)

(73) Assignee: Garmin Switzerland GmbH (CH)

( * ) Notice: Subject to any disclaimer, the term of this patent is extended or adjusted under 35 U.S.C. 154(b) by 0 days.

(21) Appl. No.: 16/135,458

(22) Filed: Sep. 19, 2018

(51) Int. Cl.

| | |
|---|---|
| ***B63C 11/22*** | (2006.01) |
| ***B63C 11/26*** | (2006.01) |
| *B63C 11/30* | (2006.01) |
| *B63C 11/18* | (2006.01) |
| *B63C 11/02* | (2006.01) |

(52) U.S. Cl.
CPC ..... *B63C 11/22* (2013.01); *B63C 11/26* (2013.01); *B63C 2011/021* (2013.01); *B63C 2011/188* (2013.01)

(58) Field of Classification Search
CPC ... B63C 11/22; B63C 11/26; B63C 2011/021; B63C 2011/188; B63C 22/06; B63C 22/18; A61B 5/08; A61B 5/024
USPC ..... 455/40
See application file for complete search history.

(56) References Cited

U.S. PATENT DOCUMENTS

| | | | | |
|---|---|---|---|---|
| 5,191,317 | A | 3/1993 | Toth et al. | 340/626 |
| 5,331,602 | A | 7/1994 | McLaren | 367/6 |
| 5,738,092 | A | 4/1998 | Mock et al. | 128/205.23 |
| 7,711,322 | B2 | 5/2010 | Rhodes et al. | 455/40 |
| RE42,218 | E | 3/2011 | Magine et al. | 367/134 |
| 8,275,311 | B2 | 9/2012 | Lindman | 455/40 |
| 8,842,498 | B2 | 9/2014 | Cahalan et al. | 367/134 |
| 9,225,435 | B2 | 12/2015 | Rahkonen et al. | |
| 9,444,556 | B1 | 9/2016 | Cahalan et al. | |

OTHER PUBLICATIONS

Hautamäki, Martin et al., ""Buddy Tracker" an Early Warning System for Recreational Divers"; Karlstads University; 2010.
Liquivision LYNX™ Air Integrated Dive Computer User Manual, 2014.
Karlsson, Erik, "Software Acoustic Modem"; Linkopings University; 2014.
Parsons, Gregory et al.; "An Ultrasonic Communication System for Biotelemetry in Extremely Shallow Waters"; 2008.

*Primary Examiner* — Lee Nguyen
(74) *Attorney, Agent, or Firm* — Samuel M. Korte; Max M. Ali

(57) ABSTRACT

A scuba tank pressure monitor system comprises a scuba tank pod and a wearable electronic device. The scuba tank pod includes an air pressure detector, a first transducer element, and a first processing element. The air pressure detector detects an internal air pressure of the scuba tank. The first transducer element transmits sonar waves including scuba tank related status data having a first frequency range. The first processing element controls the first transducer element to transmit sonar waves including the scuba tank related status data. The wearable electronic device includes a second transducer element, and a second processing element. The second transducer element receive sonar waves including the scuba tank related status data from the scuba tank pod and transmits sonar waves including alert tones having a second frequency range. The second processing element controls the second transducer element to transmit sonar waves including the alert tones.

20 Claims, 6 Drawing Sheets

SCUBA TANK AIR PRESSURE MONITOR SYSTEM

BACKGROUND

While scuba diving, a diver needs to know scuba tank related status information, such as scuba tank air pressure. Typically, a pressure gauge that measures air pressure is coupled to the scuba tank. The diver may look at the pressure gauge during a dive to see the amount of air pressure in the scuba tank and determine an amount of time he has left for diving. However, the diver may get distracted and not check the pressure gauge as often as he should, or he may have trouble seeing the gauge. This could lead to the diver not adequately preparing to return to the surface at the correct time.

SUMMARY

Embodiments of the present technology provide a system for monitoring an air pressure of a scuba tank during a dive. The system comprises a scuba tank pod and a wearable electronic device. The scuba tank pod measures the air pressure of the scuba tank and generates audible alerts to let the diver know of the status of the scuba tank air pressure. The scuba tank pod also transmits scuba tank related status data to the wearable electronic device which issues audible alert tones as well.

An embodiment of the scuba tank pod comprises an air pressure detector, a transducer element, and a processing element. The air pressure detector is configured to detect an internal air pressure of the scuba tank and to communicate an air pressure electronic signal. The transducer element is configured to transmit sonar waves including scuba tank related status data having a first frequency range and to transmit sonar waves including alert tones having a second frequency range. The processing element is configured or programmed to receive the air pressure electronic signal, determine the internal air pressure and scuba tank related status data from the air pressure electronic signal, control the transducer element to transmit sonar waves including the scuba tank related status data, and control the transducer element to transmit sonar waves including the alert tones based on the scuba tank related status data.

An embodiment of the wearable electronic device comprises a transducer element and a processing element. The transducer element configured to receive sonar waves having a first frequency range and communicate a corresponding receive electronic signal. The transducer element is further configured to transmit sonar waves including alert tones having a second frequency range. Additionally or alternatively, the wearable electronic device may utilize a buzzer, speaker, and/or piezo beeper to generate alert tones. The processing element is configured or programmed to receive the receive electronic signal, determine scuba tank related status data from the receive electronic signal, and control the transducer element to transmit sonar waves including the alert tones based on the scuba tank related status data.

An embodiment of the scuba tank pressure monitor system comprises a scuba tank pod and a wearable electronic device. The scuba tank pod includes an air pressure detector, a first transducer element, and a first processing element. The air pressure detector is configured to detect an internal air pressure of a scuba tank and communicate an air pressure electronic signal. The first transducer element is configured to transmit sonar waves including scuba tank related status data having a first frequency range. The first processing element is configured or programmed to receive the air pressure electronic signal, determine the internal air pressure and scuba tank related status data from the air pressure electronic signal, and control the first transducer element to transmit sonar waves including the scuba tank related status data.

The wearable electronic device includes a second transducer element, and a second processing element. The second transducer element is configured to receive sonar waves including the scuba tank related status data and to communicate a receive electronic signal including the scuba tank related status data. The second transducer element is further configured to transmit sonar waves including alert tones having a second frequency range. The second processing element is configured or programmed to receive the receive electronic signal, determine scuba tank related status data from the receive electronic signal, and control the second transducer element to transmit sonar waves including the alert tones based on the scuba tank related status data.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present technology will be apparent from the following detailed description of the embodiments and the accompanying drawing figures.

BRIEF DESCRIPTION OF THE DRAWING FIGURES

Embodiments of the present technology are described in detail below with reference to the attached drawing figures, wherein.

Figure 1:
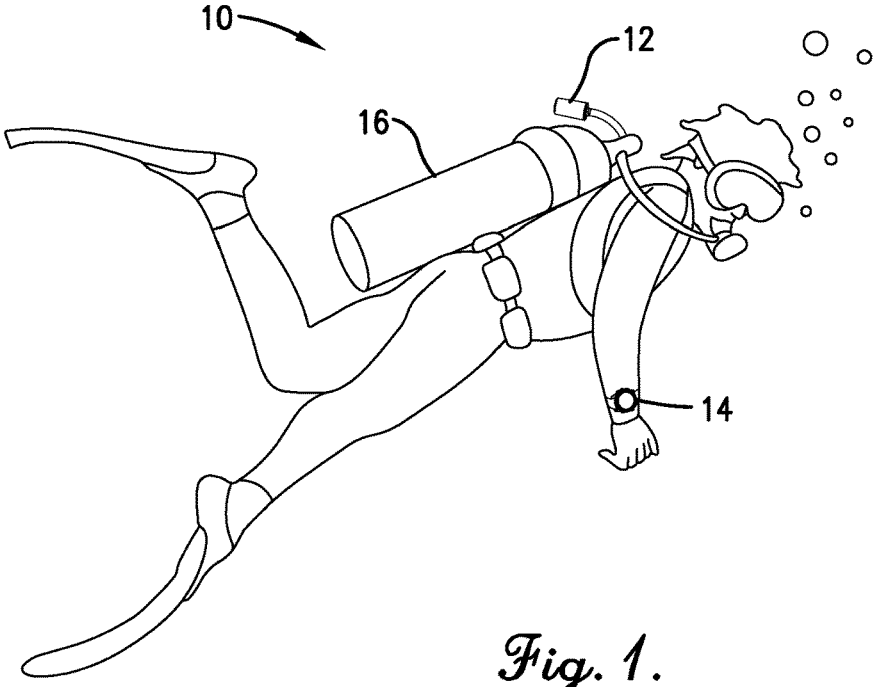
FIG. 1 is a view of an environment in which a system for monitoring scuba tank air pressure, constructed in accordance with various embodiments of the present technology, would operate, the system comprising a scuba tank pod and a wearable electronic device.

The drawing figures do not limit the present technology to the specific embodiments disclosed and described herein. While the drawings do not necessarily provide exact dimensions or tolerances for the illustrated components or structures, the drawings are to scale as examples of certain embodiments with respect to the relationships between the components of the structures illustrated in the drawings.

DETAILED DESCRIPTION

The following detailed description of the technology references the accompanying drawings that illustrate specific embodiments in which the technology can be practiced. The embodiments are intended to describe aspects of the technology in sufficient detail to enable those skilled in the art to practice the technology. Other embodiments can be utilized and changes can be made without departing from the scope of the present technology. The following detailed description is, therefore, not to be taken in a limiting sense. The scope of the present technology is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Embodiments of the present technology relate to a system for monitoring the air pressure in a diver's scuba tank during a dive. The system includes a scuba tank pod and a wearable electronic device. The scuba tank pod couples to a pressure port of the scuba tank such that it can sense an air pressure of the tank. The scuba tank pod then determines various scuba tank related data. The scuba tank pod broadcasts the scuba tank related data underwater utilizing a transducer. The scuba tank pod utilizes the same transducer to emit audible alert tones to the diver which inform the diver of the status of the air in the scuba tank. The wearable electronic device is typically worn on the wrist of the diver and receives the scuba tank related data broadcast by the scuba tank pod. The wearable electronic device utilizes a transducer to also emit audible alert tones to the diver. Additionally or alternatively, the wearable electronic device may utilize a buzzer, speaker, and/or piezo beeper to generate alert tones. In addition, the wearable electronic device monitors the diver's respiration rate as he breathes through a breathing regulator coupled to the scuba tank. The wearable electronic device emits audible alert tones to the diver based on the diver's respiration rate. The alert tones based on the diver's respiration rate may have different characteristics from the alert tones based on the scuba tank related data.

Embodiments of the technology will now be described in more detail with reference to the drawing figures. Referring initially to FIG. 1, a system 10 for monitoring scuba tank air pressure is illustrated. The system 10, constructed in accordance with various embodiments of the current technology, broadly comprises a scuba tank pod 12 and a wearable electronic device 14. The scuba tank pod 12 interfaces with a scuba tank 16 to detect internal air pressure of the scuba tank 16 during a dive. The wearable electronic device 14 may be embodied by an intelligent watch that is typically worn on a diver's wrist during a dive, although the wearable electronic device 14 may be worn on other parts of the body as well.

The scuba tank pod 12, shown in FIGS. 2-5, includes a housing 18, a fitting 20, an air pressure detector 22, a transducer element 24, a memory element 26, and a processing element 28. The scuba tank pod 12 may further include a battery to provide electric power to the electronic circuits and seals, such as O-rings, to make the scuba tank pod 12 water tight.

Figure 2:
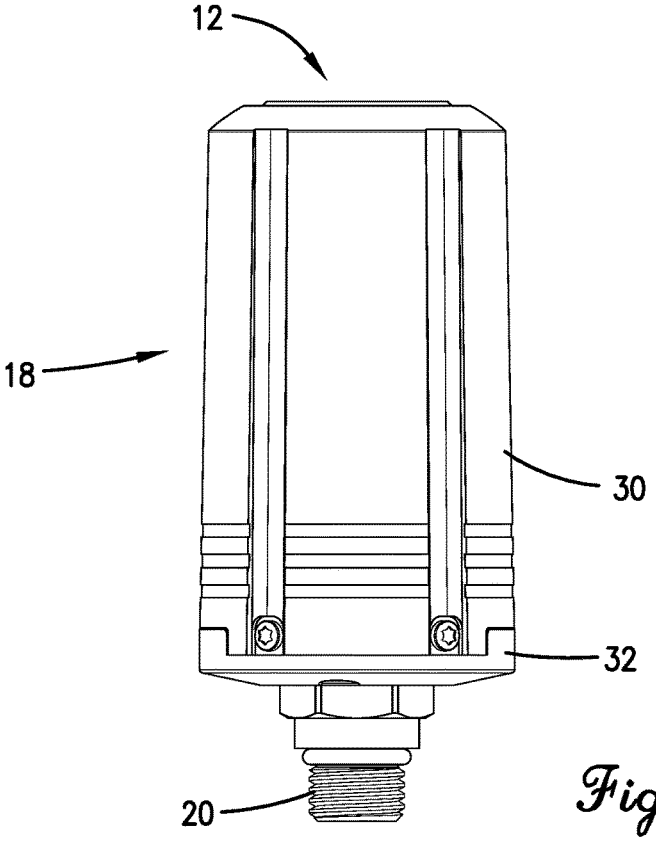
FIG. 2 is a front elevation view of the scuba tank pod illustrating a housing and a fitting to provide coupling to a scuba tank.
Figure 3:
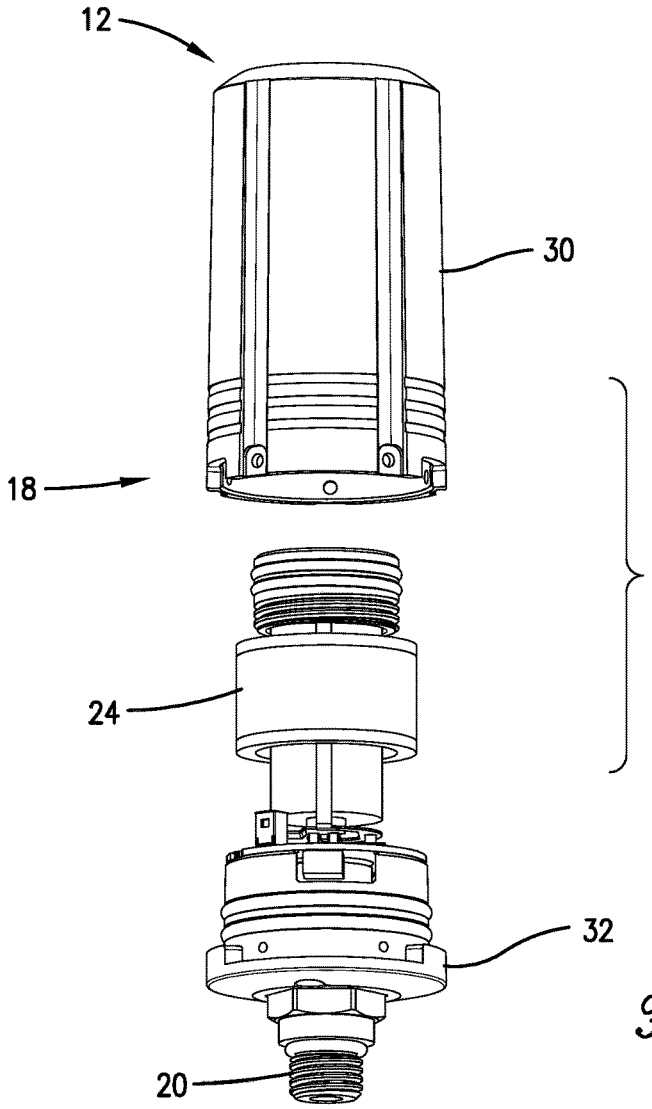
FIG. 3 is a perspective view of the scuba tank pod with a portion of the housing removed to illustrate a transducer element configured to transmit and receive sonar waves.
Figure 4:
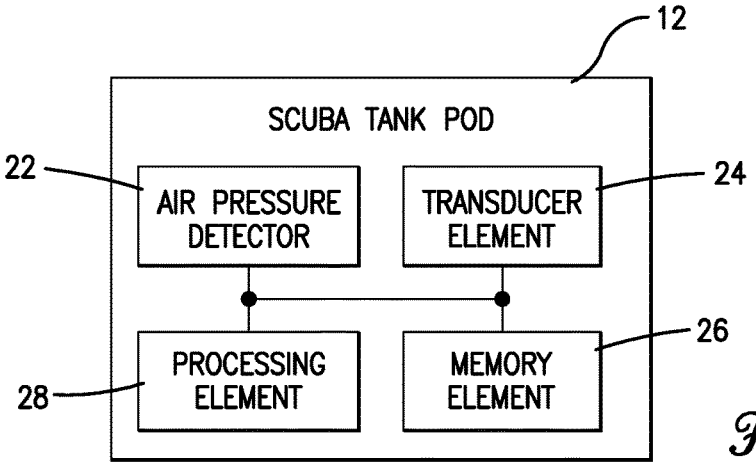
FIG. 4 is a schematic block diagram of various electronic components of the scuba tank pod.

The housing 18, shown in FIGS. 2 and 3, generally retains the electronic circuit components and exemplary embodiments include a cylindrical shell 30 which couples to a disc-shaped base 32 although other shapes or configurations are possible. The housing 18 may be formed from solid materials such as hardened plastics.

The fitting 20 extends from the base 32 of the housing 18 and includes a threaded connector that couples to an air supply hose (and/or directly to the regulator/valve assembly) which itself connects to the pressure port of the scuba tank 16 and allows the scuba tank pod 12 to interface with the scuba tank 16.

The air pressure detector 22 may include a pressure transducer or similar device that is responsive to air pressure. The air pressure detector 22 may receive input air pressure through the fitting 20. Given that the fitting 20 is coupled to a regulator/valve assembly on the scuba tank 16 pressure port during operation of the system 10, the air pressure detector 22 detects or senses the internal air pressure of the scuba tank 16 on a continuous or regular periodic basis. The air pressure detector 22 may output an air pressure electronic signal 34 that includes an analog electric voltage and/or electric current which varies according to a level of internal air pressure. Alternatively, the air pressure detector 22 may include, or be in electronic communication with, an analog-to-digital converter (ADC) which converts the analog electric voltage and/or electric current to digital data, typically generated in a stream. Thus, the air pressure electronic signal 34 may include digital data that indicates the level of internal air pressure. In certain embodiments, the data indicating the scuba tank 16 air pressure is included in the air pressure electronic signal 34 on a regular, periodic basis.

In some configurations, pod 12 may additionally include a depth sensor to sense depth information. In such configuration, sensed depth information may be broadcast by pod 12 as part of, or in addition to, air pressure electronic signal 34. Broadcast depth information may be received by other divers, or nearby dive boat receivers, to allow the location of each diver to and dive boats to be determined.

The transducer element 24 may be formed from piezoelectric material, like ceramics such as lead zirconate titanate (PZT), barium titanate, lead titanate, lithium niobate, lithium tantalate, bismuth ferrite, sodium niobate, or polymers such as polyvinylidene difluoride (PVDF), which transform electrical energy into mechanical energy and vice-versa. In exemplary embodiments shown in FIG. 3, the transducer element 24 has a hollow cylindrical shape with a single circumferential side wall having an inner surface and an outer surface. The transducer element 24 is positioned within the housing 18 such that the outer surface of the transducer element side wall is adjacent to an inner surface of the shell 30.

The transducer element 24 may function as an acoustic pressure wave transmitter or an acoustic pressure wave receiver. When operating as an acoustic pressure wave transmitter, the transducer element 24 converts electrical energy into mechanical energy. The transducer element 24 receives a transmit electronic signal 36 as an input and emits, generates, transmits, or outputs sonar waves, such as pressure, acoustical, mechanical, and/or vibrational waves, with waveform characteristics, such as amplitude, frequency, waveshape, etc., that correspond to the waveform characteristics of the transmit electronic signal 36. Thus, the sonar waves may include data or other indications that are included in the transmit electronic signal. When operating as an acoustic pressure wave receiver, the transducer element 24 converts mechanical energy into electrical energy. That is, the transducer element 24 receives sonar waves impinging on one or more of its surfaces and outputs or communicates a receive electronic signal 38 with waveform characteristics that correspond to the waveform characteristics of the sonar waves. Thus, the receive electronic signal may include data or other indications that are included in the sonar waves. In various embodiments, the transmit and receive electronic signals may be analog signals with a periodically varying electric voltage. The transmit and receive electronic signals may include other periodically varying characteristics or parameters, such as electric current.

The transducer element 24 transmits and receives sonar waves having a plurality of frequencies. For example, the transducer element 24 transmits and receives sonar waves having frequencies in a first frequency range. The first frequency range may include ultrasonic frequencies which may range from approximately 30 kilohertz (kHz) to approximately 50 kHz. Typically, data is transmitted and/or received by the transducer element 24 at the first frequency range. The transducer element 24 also transmits and receives sonar waves having a second frequency range. The second frequency range may include audible frequencies ranging from approximately 1 kHz to approximately 10 kHz. Typically, alert tones are transmitted and/or received by the transducer element 24 at the second frequency range.

The memory element 26 may be embodied by devices or components that store data in general, and digital or binary data in particular, and may include exemplary electronic hardware data storage devices or components such as read-only memory (ROM), programmable ROM, erasable programmable ROM, random-access memory (RAM) such as static RAM (SRAM) or dynamic RAM (DRAM), cache memory, hard disks, floppy disks, optical disks, flash memory, thumb drives, universal serial bus (USB) drives, or the like, or combinations thereof. In some embodiments, the memory element 26 may be embedded in, or packaged in the same package as, the processing element 28. The memory element 26 may include, or may constitute, a "computer-readable medium". The memory element 26 may store the instructions, code, code statements, code segments, software, firmware, programs, applications, apps, services, daemons, or the like that are executed by the processing element 28. The memory element 26 may also store data that is received by the processing element 28 or the device in which the processing element 28 is implemented. The processing element 28 may further store data or intermediate results generated during processing, calculations, and/or computations as well as data or final results after processing, calculations, and/or computations. In addition, the memory element 26 may store settings, data, documents, sound files, photographs, movies, images, databases, and the like.

The processing element 28 may comprise one or more processors. The processing element 28 may include electronic hardware components such as microprocessors (single-core or multi-core), microcontrollers, digital signal processors (DSPs), field-programmable gate arrays (FPGAs), analog and/or digital application-specific integrated circuits (ASICs), or the like, or combinations thereof. The processing element 28 may generally execute, process, or run instructions, code, code segments, code statements, software, firmware, programs, applications, apps, processes, services, daemons, or the like. The processing element 28 may also include hardware components such as registers, finite-state machines, sequential and combinational logic, and other electronic circuits that can perform the functions necessary for the operation of the current invention. In certain embodiments, the processing element 28 may include multiple computational components and functional blocks that are packaged separately but function as a single unit. The processing element 28 may be in electronic communication with the other electronic components through serial or parallel links that include universal busses, address busses, data busses, control lines, and the like.

Figure 5:
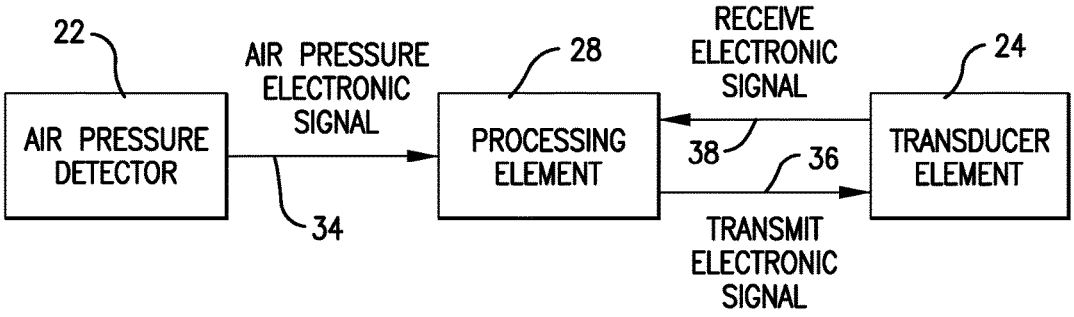
FIG. 5 is a schematic block diagram illustrating a plurality of electronic signals communicated between various electronic components of the scuba tank pod.

The processing element 28 may be operable, configured, or programmed to perform the following functions by utilizing hardware, software, firmware, or combinations thereof. With reference to FIG. 5, the processing element 28 receives the air pressure electronic signal 34 from the air pressure detector 22. In some embodiments, if the air pressure electronic signal 34 includes analog electric voltage and/or electric current levels indicating the internal air pressure of the scuba tank 16, then the processing element 28 may further include, or be in electronic communication with, one or more ADCs to convert the analog levels to digital data ("air pressure data"). In other embodiments, the air pressure electronic signal 34 already includes air pressure data. Given the air pressure data as input, the processing element 28 may utilize or apply algorithms, artificial intelligence, mathematical equations, and the like to calculate, compute, or determine scuba tank 16 related parameters, information, or data, such as air volume, potential time left during a dive, and so forth. At least a portion of the air pressure data and/or the calculated parameters may be stored in the memory element 26.

The processing element 28 controls the transducer element 24 to transmit data regarding the scuba tank 16 status or alert tones. The scuba tank 16 status data may include all of the scuba tank 16 parameters discussed above as well as a tank identification code in case the scuba tank 16 status data is received by other divers. The processing element 28 outputs or generates the transmit electronic signal 36 which is received by the transducer element 24. In some embodiments, the processing element 28 may further include, or be in electronic communication with, electronic signal processing components such as waveform generators, amplifiers, filters, ADCs, digital-to-analog converters (DACs), and the like. The electronic signal processing components may allow the processing element 28 to generate the periodic waveform voltage that will directly drive the transducer element 24.

The processing element 28 includes scuba tank 16 data in the transmit electronic signal 36 such that the transmit electronic signal 36 has a frequency in the first frequency range. The processing element 28 includes the scuba tank 16 data in the transmit electronic signal 36 on regular, periodic basis.

The processing element 28 includes alert tones in the transmit electronic signal 36 such that the transmit electronic signal 36 has a frequency in the second frequency range. Each alert tone is a pure tone, such as a sine wave, having a frequency in the audible frequency range and being generated for a first period of time with a second period of time between successive alert tones. For example, each alert tone may have a frequency of 5 kHz and a duration of 0.5 seconds with 0.25 seconds between alert tones. The number of alert tones included in the transmit electronic signal 36 may correspond, or vary according, to a scuba tank 16 related parameter, such as period of time of air left in the scuba tank 16 for a dive. For example, the processing element 28 may include 10 alert tones in the transmit electronic signal 36 to indicate 10 minutes of air left, 5 alert tones to indicate 5 minutes of air left, 2 alert tones to indicate 2 minutes of air left, and so forth. The processing element 28 includes the alert tones in the transmit electronic signal 36 at times which vary according to the scuba tank 16 related status data. In other words, the processing element 28 includes the alert tones in the transmit electronic signal 36 at the appropriate times to generate an alert, such as when there is a certain amount of air left in the scuba tank 16.

It is possible that the processing element 28 may vary other aspects of the alert tones to indicate scuba tank 16 parameters. For instance, the processing element 28 may vary the frequency of each alert tone, the duration of each alert tone, etc.

The receive electronic signal received by the processing element 28 may also include scuba tank 16 related data regarding another scuba tank 16 when the transducer element 24 receives sonar waves from another scuba tank 16.

The processing element 28 also receives the receive electronic signal 38 from the transducer element 24 when scuba tank pod 12 receives data from other scuba tank pods 12 or from the wearable electronic device 14. The receive electronic signal 38 may have electric voltage and/or electric current frequency and amplitude, as well as other waveform characteristics, that correspond, or vary according, to the sonar waves that impinge surfaces of the transducer element 24. The receive electronic signal 38 may be processed by the electronic signal processing components of the processing element 28 to be converted to digital data.

Figure 6:
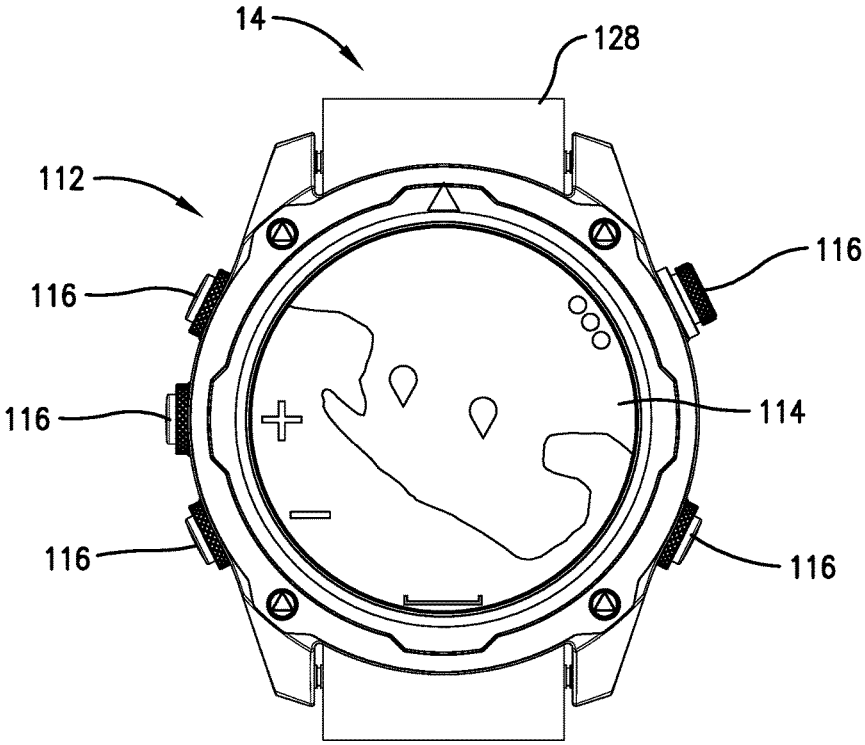
FIG. 6 is a top view of the wearable electronic device illustrating a display, a housing, and a wrist band.
Figure 7:
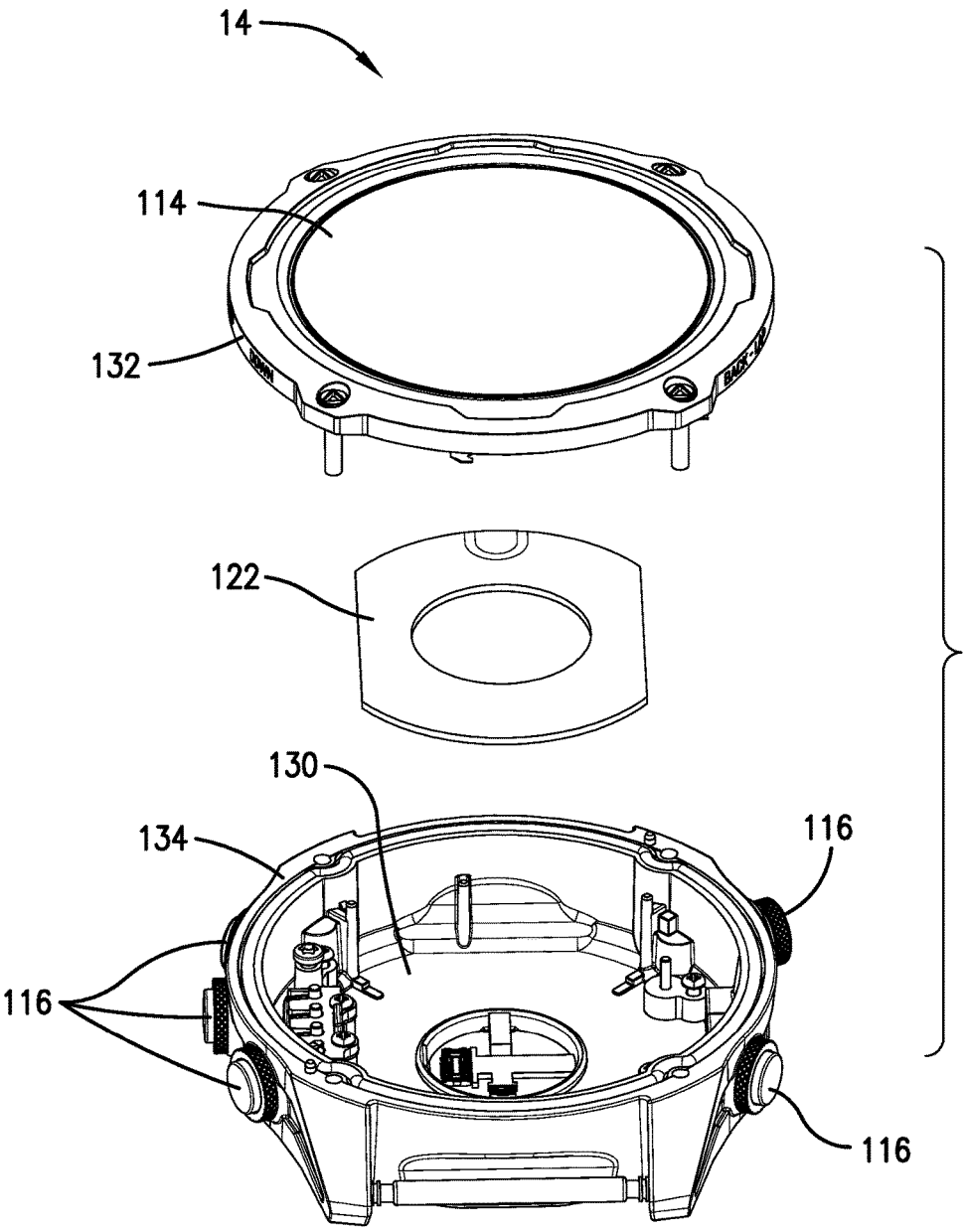
FIG. 7 is a perspective view of the wearable electronic device with the display and an upper wall of the housing removed to illustrate a transducer element configured to transmit and receive sonar waves.
Figure 8:
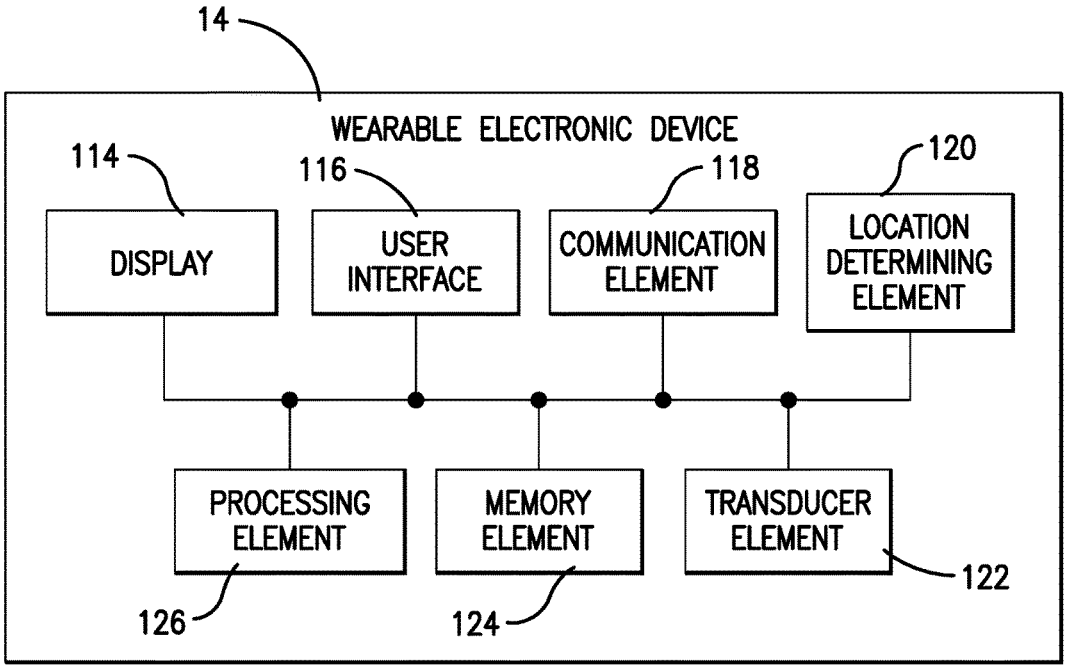
FIG. 8 is a schematic block diagram of various electronic components of the wearable electronic device.

In preparation for a dive, the fitting 20 of the scuba tank pod 12 is connected to one end of an air supply hose and/or regulator/valve assembly. The other end of the hose is connected to the scuba tank 16 pressure port in embodiments where the fitting 20 is not directly coupled to the regulator/valve assembly. During the dive, the scuba tank pod 12 may function or operate, at least in part, as follows. The air pressure detector 22 detects or senses the air pressure of the scuba tank 16 and communicates the air pressure electronic signal 34 including air pressure data. The processing element 28 receives the air pressure electronic signal 34 and calculates, computes, or determines scuba tank 16 related status data. The processing element 28 communicates the transmit electronic signal 36 to the transducer element 24. The processing element 28 includes scuba tank 16 related status data in the transmit electronic signal 36 on a regular, periodic basis. Accordingly, the transducer element 24 transmits sonar waves that include the scuba tank 16 related status data. The processing element 28 includes alert tones in the transmit electronic signal 36 as necessary to make the diver aware of parameters such as amount of air left in the scuba tank 16. Accordingly, the transducer element 24 transmits sonar waves that include the alert tones. The wearable electronic device 14, as shown in FIGS. 6-8, includes a housing 112, a display 114, a user interface 116, a communication element 118, a location determining element 120, a transducer element 122, a memory element 124, and a processing element 126.

The housing 112 generally houses or retains other components of the wearable electronic device 14 and may include or be coupled to a wrist band 128. As seen in FIGS. 6 and 7, the housing 112 may include a bottom wall 130, an upper wall 132, and at least one side wall 134 that bound an internal cavity. The bottom wall 130 may include a lower, outer surface that contacts the user's wrist while the user is wearing the wearable electronic device 14. In some embodiments, such as the exemplary embodiments shown in the figures, the bottom wall 130 of the housing 112 may have a round, circular, or oval shape, with a single circumferential side wall 134. In other embodiments, the bottom wall 130 may have a four-sided shape, such as a square or rectangle, or other polygonal shape, with the housing 112 including four or more sidewalls.

The display 114 generally presents the information mentioned above, such as time of day, current location, and the like. The display 114 may be implemented in one of the following technologies: light-emitting diode (LED), organic LED (OLED), Light Emitting Polymer (LEP) or Polymer LED (PLED), liquid crystal display (LCD), thin film transistor (TFT) LCD, LED side-lit or back-lit LCD, or the like, or combinations thereof. In some embodiments, the display 114 may have a round, circular, or oval shape. In other embodiments, the display 114 may possess a square or a rectangular aspect ratio which may be viewed in either a landscape or a portrait orientation.

The user interface 116 generally allows the user to directly interact with the wearable electronic device 14 and may include a plurality of pushbuttons, rotating knobs, or the like. In various embodiments, the display 114 may also include a touch screen occupying the entire display 114 or a portion thereof so that the display 114 functions as at least a portion of the user interface 116. The touch screen may allow the user to interact with the wearable electronic device 14 by physically touching, swiping, or gesturing on areas of the display 114.

The communication element 118 generally allows the wearable electronic device 14 to communicate with other computing devices, external systems, networks, and the like. The communication element 118 may include signal and/or data transmitting and receiving circuits, such as antennas, amplifiers, filters, mixers, oscillators, digital signal processors (DSPs), and the like. The communication element 118 may establish communication wirelessly by utilizing radio frequency (RF) signals and/or data that comply with communication standards such as cellular 2G, 3G, 4G, Voice over Internet Protocol (VoIP), LTE, Voice over LTE (VoLTE) or 5G, Institute of Electrical and Electronics Engineers (IEEE) 802.11 standard such as WiFi, IEEE 802.16 standard such as WiMAX, Bluetooth™, or combinations thereof. In addition, the communication element 118 may utilize communication standards such as ANT, ANT+, Bluetooth™ low energy (BLE), the industrial, scientific, and medical (ISM) band at 2.4 gigahertz (GHz), or the like. The communication element 118 may be in electronic communication with the memory element 124 and the processing element 126.

The location determining element 120 generally determines a current geolocation of the wearable electronic device 14 and may receive and process radio frequency (RF) signals from a global navigation satellite system (GNSS) such as the global positioning system (GPS) primarily used in the United States, the GLONASS system primarily used in the Soviet Union, or the Galileo system primarily used in Europe. The location determining element 120 may accompany or include an antenna to assist in receiving the satellite signals. The antenna may be a patch antenna, a linear antenna, or any other type of antenna that can be used with location or navigation devices. The location determining element 120 may include satellite navigation receivers, processors, controllers, other computing devices, or combinations thereof, and memory. The location determining element 120 may process a signal, referred to herein as a "location signal", from one or more satellites that includes data from which geographic information such as the current geolocation is derived. The current geolocation may include coordinates, such as the latitude and longitude, of the current location of the wearable electronic device 14. The location determining element 120 may communicate the current geolocation to the processing element 126, the memory element 124, or both.

Although embodiments of the location determining element 120 may include a satellite navigation receiver, it will be appreciated that other location-determining technology may be used. In some configurations, the location determining element 120 may couple with transducer element 122 to directly or indirectly determine location. For example, location determining element 120 and transducer element 122 may be configured to receive sonar signals from known positions (e.g., beacons from fixed locations, beacons from a boat having a known location, beacons from another diver having a known location, etc.) and calculate its position based the one or more received sonar signals. In other configurations, cellular towers or any customized transmitting radio frequency towers can be used instead of satellites may be used to determine the location of the wearable electronic device 14 by receiving data from at least three transmitting locations and then performing basic triangulation calculations to determine the relative position of the device with respect to the transmitting locations. With such a configuration, any standard geometric triangulation algorithm can be used to determine the location of the electronic device. The location determining element 120 may also include or be coupled with a pedometer, accelerometer, compass, or other dead-reckoning components which allow it to determine the location of the wearable electronic device 14. The location determining element 120 may determine the current geographic location through a communications network, such as by using Assisted GPS (A-GPS), or from another electronic device. The location determining element 120 may even receive location data directly from a user.

The transducer element 122 may be formed from piezoelectric material. In exemplary embodiments shown in FIG. 7, the transducer element 122 has a roughly planar disc shape with a central opening and diametrically opposing flat edges. The transducer element 122 is positioned adjacent to an upper surface of the bottom wall 130 of the housing 112. Like the transducer element 24, the transducer element 122 transmits sonar waves in response to receiving a transmit electronic signal 136, wherein the waveform characteristics, such as amplitude, frequency, wave shape, etc., of the sonar waves correspond to the waveform characteristics of the transmit electronic signal 136.

The transducer element 122 also receives sonar waves impinging on one or more of its surfaces and outputs or communicates a receive electronic signal 138 with waveform characteristics that correspond to the waveform characteristics of the sonar waves. At some time, the transducer element 122 receives sonar waves from the scuba tank pod 12, wherein the sonar waves include scuba tank 16 related status data. The receive electronic signal 138 accordingly includes the scuba tank 16 related status data. At other times, the transducer element 122 receives sonar waves from the diver, specifically from the diver's breathing regulator as the diver is breathing, such as for each breath. Bubbles from the breathing regulator (during each breath) generate sonar waves which are received by the transducer element 122. Accordingly, the receive electronic signal 138 includes data or other indicators of the diver's respiration or breathing.

The transducer element 122 transmits and receives sonar waves having a plurality of frequencies, particularly in the first and second range of frequencies as discussed above for the transducer element 24.

The memory element 124 may be substantially similar to the memory element 26 in structure and function.

Figure 9:
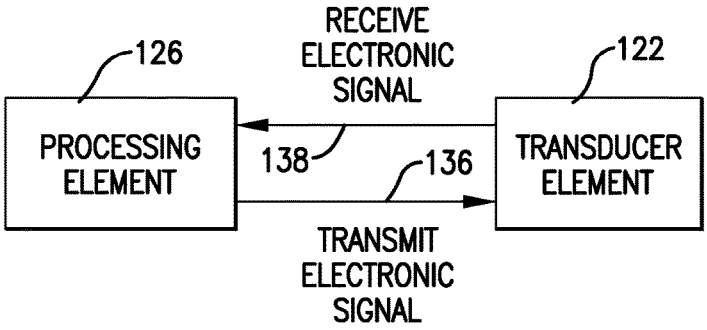
FIG. 9 is a schematic block diagram illustrating a plurality of electronic signals communicated between various electronic components of the wearable electronic device.

The processing element 126 may substantially similar to the processing element 28 in structure. Thus, the processing element 126 may include, or be in electronic communication with, electronic signal processing components such as waveform generators, amplifiers, filters, ADCs, digital-to-analog converters (DACs), and the like. The processing element 126 may be operable, configured, or programmed to perform the following functions by utilizing hardware, software, firmware, or combinations thereof. With reference to FIG. 9, the processing element 126 receives the receive electronic signal 138 from the transducer element 122 as a result of sonar waves impinging one or more of its surfaces. In a first situation, the receive electronic signal 138 includes scuba tank 16 related status data that was transmitted from the scuba tank pod 12. The data may include an identification of the scuba tank 16, air pressure and volume within the scuba tank 16, potential time left during a dive, and so forth. In certain embodiments, at least a portion of the scuba tank 16 related status data is stored in the memory element 124.

Given the scuba tank 16 related data, the processing element 126 controls the transducer element 122 to generate alert tones. Specifically, the processing element 126 communicates the transmit electronic signal 136 to the transducer element 122 and includes alert tones in the transmit electronic signal 136. The alert tones are substantially similar to the alert tones included in the transmit electronic signal 36 discussed above in association with the processing element 28. Thus, the processing element 126 includes the alert tones in the transmit electronic signal 136 at the appropriate times to generate an alert, such as when there is a certain amount of air left in the scuba tank 16. And, at least one parameter of the alert tones, such as the number of alert tones may correspond, or vary according, to the scuba tank 16 related status data. Having the wearable electronic device 14 transmit alert tones in addition to the scuba tank pod 12 may provide a backup or redundancy for this feature. In some embodiments, alert tones may be generated using components other than, or in addition to, transducer element 122. For example, the wearable electronic device 14 may include a buzzer, speaker, and/or piezo beeper to generate the alert tones.

In some embodiments, the wearable electronic device 14 may also rebroadcast the scuba tank 16 related data. Thus, the processing element 126 includes the scuba tank 16 related data in the transmit electronic signal 136 communicated to the transducer element 122. Having the wearable electronic device 14 transmit scuba tank 16 related data in addition to the scuba tank pod 12 may provide a backup or redundancy for this feature.

The processing element 126 may also control the display 114 to show information regarding the scuba tank 16. The information may updated on the display 114 shortly after it is received by the processing element 126.

Figure 10:
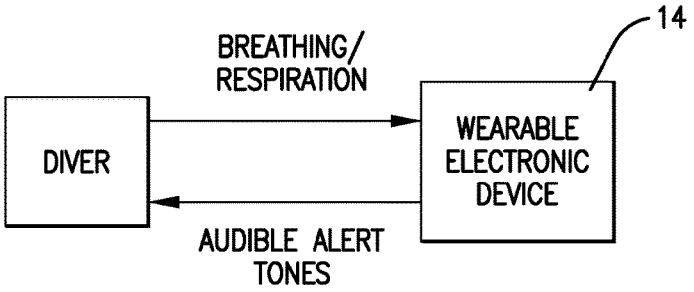
FIG. 10 is a schematic block diagram illustrating a flow of information between the components of the system and between the system and the diver.

With reference to FIG. 10, in a second situation, the receive electronic signal 138 includes an indication of respiration or breathing from the diver every time the diver breathes. The breathing, or breath, of the diver may have a distinctive or identifiable waveform or data pattern. The processing element 126 may utilize or apply algorithms, artificial intelligence, mathematical equations, and the like to identify that a breath has occurred. After at least two breaths have been identified or detected, the processing element 126 calculates, computes, or determines diver performance metrics, parameters, information, or data, such as respiration/breathing rate, consumption of gas or air in the scuba tank 16, potential time left during a dive, and so forth. In certain embodiments, at least a portion of the respiration rate data is stored in the memory element 124.

The processing element 126 may utilize the respiration data of the diver in addition to, or instead of, the scuba tank 16 related status data to generate alert tones. Based on this data, the processing element 126 may include alert tones in the transmit electronic signal 136 in the same manner described above. In addition, the processing element 126 may include breathing alert tones in the transmit electronic signal 136 when the diver's breathing rate is above a threshold value to encourage the diver to slow his breathing, if possible. The breathing alert tones may be different from the alert tones regarding an amount of time left for a dive. For example, the breathing alert tones may have a different number of tones, a different tone frequency, a different tone duration, etc., from the alert tones regarding an amount of time left for a dive.

The processing element 126 may also control the display 114 to show dive-related information, such as the diver's respiration rate, consumption of air in the scuba tank 16, etc. The information may updated on the display 114 shortly after it is determined by the processing element 126.

The wearable electronic device 14 may function or operate, at least in part, as follows. The transducer element 122 receives sonar waves from the scuba tank pod 12 that include scuba tank 16 related status data. The transducer element 122 includes the scuba tank 16 related status data in the receive electronic signal 138 communicated to the processing element 126. Based on the scuba tank 16 related status data, the processing element 126 includes alert tones in the transmit electronic signal 136 that is communicated to the transducer element 122. In turn, the transducer element 122 transmits sonar waves that include the alert tones. The processing element 126 includes the alert tones in the transmit electronic signal 136 as necessary to make the diver aware of parameters such as amount of air left in the scuba tank 16.

Furthermore, the transducer element 122 receives sonar waves resulting from bubbles released from the diver's breathing regulator every time the diver breathes. The transducer element 122 includes an indication of the diver's respiration or breathing in the receive electronic signal 138 that is communicated to the processing element 126. The processing element 126 identifies the diver's breathing from the receive electronic signal 138 and determines diver parameters such as breathing rate, consumption of gas or air in the scuba tank 16, potential time left during a dive, and so forth. Based on this data, the processing element 126 may control the transducer element 122 to transmit sonar waves that include the alert tones, and/or the processing element 126 may control the transducer element 122 to transmit sonar waves that include breathing alert tones.

Figure 11:
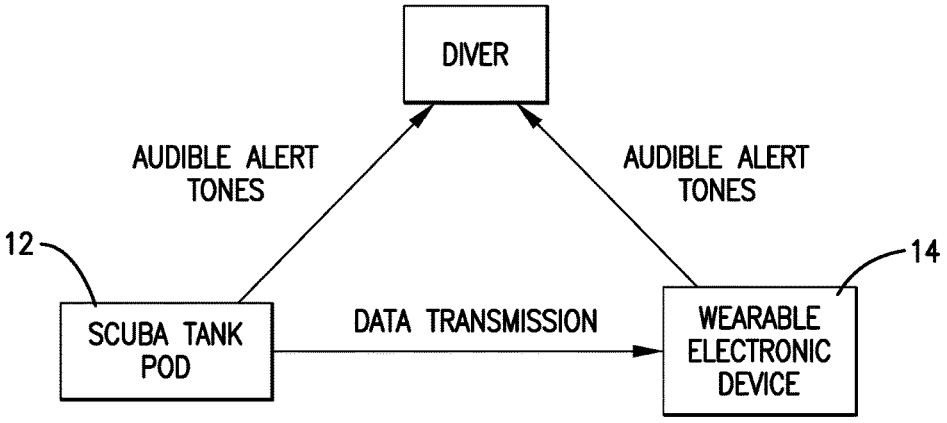
FIG. 11 is a schematic block diagram illustrating a flow of information between the wearable electronic device and the diver.

With reference to FIG. 11, the system 10, including the scuba tank pod 12 and the wearable electronic device 14, may function or operate, at least in part, as follows. On the scuba tank pod 12, the air pressure detector 22 detects or senses the air pressure of the scuba tank 16 and communicates the air pressure electronic signal 34 including air pressure data. The processing element 28 receives the air pressure electronic signal 34 and calculates, computes, or determines scuba tank 16 related status data. The processing element 28 communicates the transmit electronic signal 36 to the transducer element 24. The processing element 28 includes scuba tank 16 related status data in the transmit electronic signal 36 on a regular, periodic basis. Accordingly, the transducer element 24 transmits sonar waves that include the scuba tank 16 related status data. The processing element 28 includes alert tones in the transmit electronic signal 36 as necessary to make the diver aware of parameters such as amount of air left in the scuba tank 16. Accordingly, the transducer element 24 transmits sonar waves that include the alert tones.

On the wearable electronic device 14, the transducer element 122 receives sonar waves from the scuba tank pod 12 that include scuba tank 16 related status data. The transducer element 122 includes the scuba tank 16 related status data in the receive electronic signal 138 communicated to the processing element 126. Based on the scuba tank 16 related status data, the processing element 126 includes alert tones in the transmit electronic signal 136 that is communicated to the transducer element 122. In turn, the transducer element 122 transmits sonar waves that include the alert tones. The processing element 126 includes the alert tones in the transmit electronic signal 136 as necessary to make the diver aware of parameters such as amount of air left in the scuba tank 16.

Furthermore, the transducer element 122 receives sonar waves resulting from bubbles released from the diver's breathing regulator every time the diver breathes. The transducer element 122 includes an indication of the diver's respiration or breathing in the receive electronic signal 138 that is communicated to the processing element 126. The processing element 126 identifies the diver's breathing from the receive electronic signal 138 and determines diver parameters such as breathing rate, consumption of gas or air in the scuba tank 16, potential time left during a dive, and so forth. Based on this data, the processing element 126 may control the transducer element 122 to transmit sonar waves that include the alert tones, and/or the processing element 126 may control the transducer element 122 to transmit sonar waves that include breathing alert tones.

Although the technology has been described with reference to the embodiments illustrated in the attached drawing figures, it is noted that equivalents may be employed and substitutions made herein without departing from the scope of the technology as recited in the claims.

What is claimed is:

1. A scuba tank pod configured to interface with a scuba tank, the scuba tank pod comprising:

an air pressure detector configured to detect an internal air pressure of the scuba tank and communicate an air pressure electronic signal;

a transducer element configured to transmit sonar waves including scuba tank related status data having a first frequency range and transmit sonar waves including alert tones having a second frequency range; and a processing element in electronic communication with a memory element, the processing element configured or programmed to receive the air pressure electronic signal, determine the internal air pressure and scuba tank related status data from the air pressure electronic signal, control the transducer element to transmit sonar waves including the scuba tank related status data, and control the transducer element to transmit sonar waves including the alert tones based on the scuba tank related status data.

2. The scuba tank pod of claim 1, wherein the transducer element transmits sonar waves including the scuba tank related status data having the first frequency ranging from approximately 30 kilohertz to approximately 50 kilohertz.

3. The scuba tank pod of claim 1, wherein the transducer element transmits sonar waves including alert tones having the second frequency ranging from approximately 1 kilohertz to approximately 10 kilohertz.

4. The scuba tank pod of claim 1, wherein the processing element controls the transducer element to transmit sonar waves including the scuba tank related status data on a regular, periodic basis.

5. The scuba tank pod of claim 1, wherein the processing element controls the transducer element to transmit sonar waves including the alert tones at times which vary according to the scuba tank related status data.

6. The scuba tank pod of claim 1, further comprising a fitting configured to receive air pressure from the scuba tank.

7. The scuba tank pod of claim 1, wherein the transducer element has a hollow cylindrical shape including a circumferential side wall having an inner surface and an outer surface.

8. The scuba tank pod of claim 7, further comprising a housing including a hollow roughly cylindrical shell and the transducer element is positioned within the housing such that the outer surface of the transducer element is adjacent to an inner surface of the shell.

9. A wearable electronic device for use with scuba diving, the wearable electronic device comprising:

a transducer element configured to receive sonar waves having a first frequency range and communicate a corresponding receive electronic signal, the transducer element further configured to transmit sonar waves including alert tones having a second frequency range; and a processing element in electronic communication with a memory element, the processing element configured or programmed to receive the receive electronic signal, determine scuba tank related status data from the receive electronic signal, and control the transducer element to transmit sonar waves including the alert tones based on the scuba tank related status data.

10. The wearable electronic device of claim 9, wherein the transducer element receives sonar waves having the first frequency ranging from approximately 30 kilohertz to approximately 50 kilohertz.

11. The wearable electronic device of claim 9, wherein the transducer element transmits sonar waves including alert tones having the second frequency ranging from approximately 1 kilohertz to approximately 10 kilohertz.

12. The wearable electronic device of claim 9, wherein the processing element controls the transducer element to transmit sonar waves including the alert tones at times which vary according to the scuba tank related status data.

13. The wearable electronic device of claim 9, wherein the transducer element has a roughly planar disc shape with a central opening and diametrically opposing flat edges.

14. The wearable electronic device of claim 9, further comprising a housing including a bottom wall and the transducer element is positioned within the housing adjacent to an upper surface of the bottom wall.

15. A scuba tank pressure monitor system comprising:

a scuba tank pod including an air pressure detector configured to detect an internal air pressure of a scuba tank and communicate an air pressure electronic signal;

a first transducer element configured to transmit sonar waves including scuba tank related status data having a first frequency range; and a first processing element in electronic communication with a first memory element, the first processing element configured or programmed to receive the air pressure electronic signal, determine the internal air pressure and scuba tank related status data from the air pressure electronic signal, and control the first transducer element to transmit sonar waves including the scuba tank related status data; and a wearable electronic device including a second transducer element configured to receive sonar waves including the scuba tank related status data and communicate a receive electronic signal including the scuba tank related status data, the second transducer element further configured to transmit sonar waves including alert tones having a second frequency range; and a second processing element in electronic communication with a second memory element, the second processing element configured or programmed to receive the receive electronic signal, determine scuba tank related status data from the receive electronic signal, and control the second transducer element to transmit sonar waves including the alert tones based on the scuba tank related status data.

16. The system of claim 15, wherein the first transducer element transmits sonar waves including the scuba tank related status data having the first frequency ranging from approximately 30 kilohertz to approximately 50 kilohertz.

17. The system of claim 15, wherein the second transducer element transmits sonar waves including alert tones having the second frequency ranging from approximately 1 kilohertz to approximately 10 kilohertz.

18. The system of claim 15, wherein the first processing element controls the first transducer element to transmit sonar waves including the scuba tank related status data on a regular, periodic basis.

19. The system of claim 15, wherein the second processing element controls the second transducer element to transmit sonar waves including the alert tones at times which vary according to the scuba tank related status data.

20. The system of claim 15, wherein the first transducer element is further configured to transmit sonar waves including alert tones and the first processing element is further configured or programmed to control the first transducer element to transmit sonar waves including the alert tones.

* * * * *